US010775821B2

(12) United States Patent
Yasusaka

(10) Patent No.: US 10,775,821 B2
(45) Date of Patent: Sep. 15, 2020

(54) REGULATOR WITH REDUCED POWER CONSUMPTION USING CLAMP CIRCUIT

(71) Applicant: Rohm Co., Ltd., Kyoto (JP)

(72) Inventor: Makoto Yasusaka, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 16/269,904

(22) Filed: Feb. 7, 2019

(65) Prior Publication Data

US 2019/0243401 A1 Aug. 8, 2019

(30) Foreign Application Priority Data

Feb. 8, 2018 (JP) ..... 2018-021198

(51) Int. Cl.
*G05F 1/575* (2006.01)
*G05F 1/565* (2006.01)
*G05F 1/153* (2006.01)

(52) U.S. Cl.
CPC ..... *G05F 1/575* (2013.01); *G05F 1/153* (2013.01); *G05F 1/565* (2013.01)

(58) Field of Classification Search
CPC ..... G05F 1/575; G05F 1/153; G05F 1/565
See application file for complete search history.

(56) References Cited

U.S. PATENT DOCUMENTS 6,201,375 B1 * 3/2001 Larson ..... G05F 1/573 323/277
7,615,977 B2 * 11/2009 Gicquel ..... G05F 3/262 323/273
7,646,574 B2 * 1/2010 Imura ..... G05F 1/575 323/274
7,710,090 B1 * 5/2010 Kimura ..... G05F 1/5735 323/276
8,508,199 B2 * 8/2013 Arigliano ..... G05F 1/573 323/274
8,680,828 B2 * 3/2014 Heng ..... G05F 1/575 323/275
9,886,045 B2 * 2/2018 Endo ..... G05F 1/575
2008/0007231 A1 * 1/2008 Maige ..... G05F 1/575 323/225
2009/0273323 A1 * 11/2009 Kimura ..... G05F 1/56 323/265
2010/0156379 A1 * 6/2010 Marino ..... G01R 19/16552 323/293

FOREIGN PATENT DOCUMENTS

JP H03-158912 7/1991

* cited by examiner

*Primary Examiner* — Kyle J Moody
(74) *Attorney, Agent, or Firm* — Fish & Richardson P.C.

(57) ABSTRACT

A regulator includes: a first transistor connected between an input terminal and an output terminal; a feedback circuit configured to control a control voltage of a control electrode of the first transistor such that a voltage of the output terminal approaches a target voltage according to a feedback voltage proportional to the voltage of the output terminal; a second transistor having one end connected to the input terminal and a control electrode to which the control voltage is applied in common with the first transistor; and a clamp circuit configured to set the other end of the second transistor to a voltage determined by the voltage of the output terminal.

4 Claims, 7 Drawing Sheets

REGULATOR WITH REDUCED POWER CONSUMPTION USING CLAMP CIRCUIT

CROSS-REFERENCE TO RELATED APPLICATION

This application is based upon and claims the benefit of priority from Japanese Patent Application No. 2018-021198, filed on Feb. 8, 2018, the entire contents of which are incorporated herein by reference.

TECHNICAL FIELD

The present disclosure relates to a regulator.

BACKGROUND

In the related art, a regulator having low current consumption and high load response performance is disclosed. The regulator includes a small-size current detection MOSFET, which is in mirror relation with an output MOSFET, to detect a load of the output MOSFET and increase a current of an error amplifier only when the load is high, thereby increasing the responsiveness.

However, since a semiconductor integrated circuit for the regulator disclosed in the related art has a circuit configuration in which the gates and sources of the output MOSFET and the current detection MOSFET are shared, under the condition that the output MOSFET is made completely conductive (for example, when an input voltage is lower than an output set voltage), there is a problem that a load current is constantly detected regardless of the state of the load, resulting in an increase in current consumption. Therefore, there is a need for further improvement in terms of reduction of current consumption.

SUMMARY

Some embodiments of the present disclosure provide a regulator with reduced power consumption.

According to an embodiment of the present disclosure, there is provided a regulator. The regulator includes: a first transistor connected between an input terminal and an output terminal; a feedback circuit configured to control a control voltage of a control electrode of the first transistor such that a voltage of the output terminal approaches a target voltage according to a feedback voltage proportional to the voltage of the output terminal; a second transistor having one end connected to the input terminal and a control electrode to which the control voltage is applied in common with the first transistor; and a clamp circuit configured to set the other end of the second transistor to a voltage determined by the voltage of the output terminal.

In some embodiments, the first transistor and the second transistor are P-channel field effect transistors whose sources are connected to each other. The clamp circuit includes: a third transistor which is a PNP transistor having an emitter connected to the output terminal, and a base and a collector that are connected to a current source; and a fourth transistor which is a PNP transistor having an emitter connected to the drain of the second transistor, and a base connected to the base and the collector of the third transistor.

In some embodiments, the first transistor and the second transistor are P-channel field effect transistors whose sources are connected to each other. The clamp circuit includes: a third transistor which is a P-channel field effect transistor having a source connected to the output terminal, and a gate and a drain that are connected to a current source; and a fourth transistor which is a P-channel field effect transistor having a source to which the drain of the second transistor is connected, and a gate to which the gate and the drain of the third transistor are connected.

In some embodiments, a size of the third transistor is equal to a size of the fourth transistor.

In some embodiments, a size of the third transistor is larger than a size of the fourth transistor.

In some embodiments, the first transistor and the second transistor are P-channel field effect transistors whose sources are connected to each other. The clamp circuit includes: a third transistor which is an NPN transistor having a collector to which the input terminal is connected, a base to which the output terminal is connected, and an emitter to which a current source is connected; and a fourth transistor which is a PNP transistor having an emitter to which the drain of the second transistor is connected, and a base to which the emitter of the third transistor is connected.

In some embodiments, the first transistor and the second transistor are P-channel field effect transistors whose sources are connected to each other. The clamp circuit includes: a comparison circuit having a negative input node to which the output terminal is connected, and a positive input node to which the drain of the second transistor is connected; and a third transistor which is a P-channel field effect transistor having a source to which the drain of the second transistor is connected, and a gate that receives an output of the comparison circuit.

DETAILED DESCRIPTION

Figure 1:
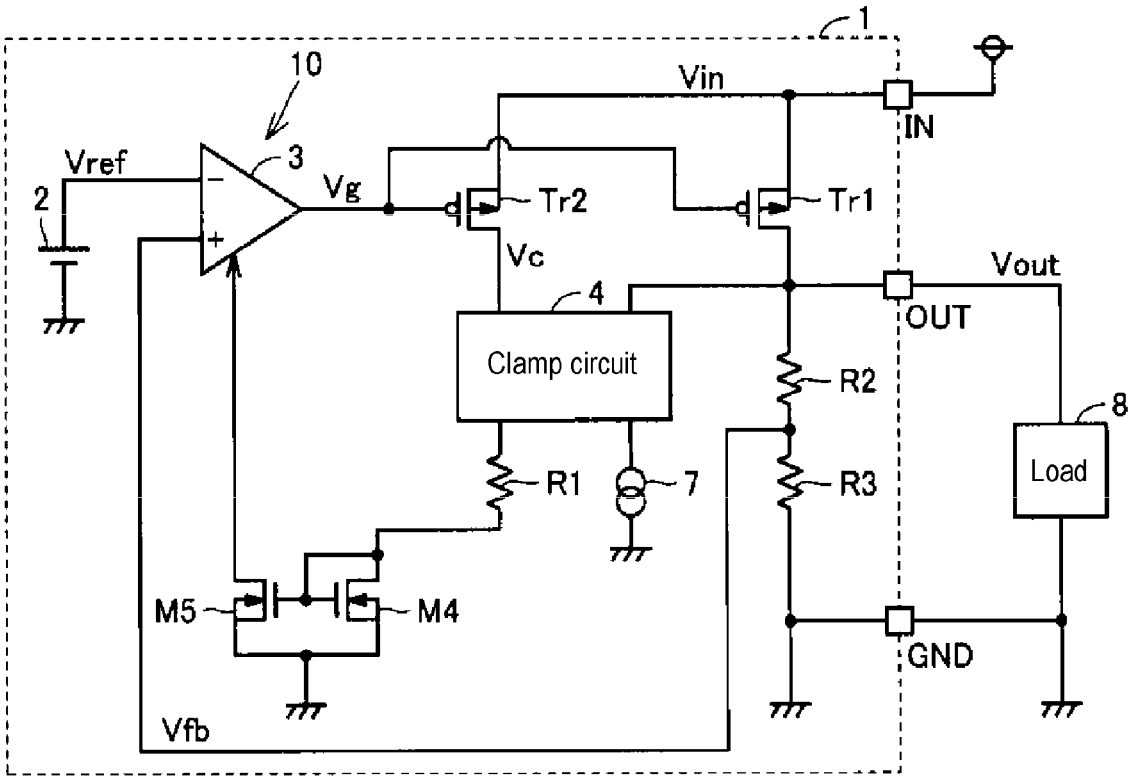
FIG. 1 is a circuit diagram showing a configuration of a regulator according to a first embodiment.

Embodiments of the present disclosure will now be described in detail with reference to the drawings. Like or equivalent components, members, and processes illustrated in each drawing are given like reference numerals and a repeated description thereof will be properly omitted.

First Embodiment

FIG. 1 is a circuit diagram showing a configuration of a regulator according to a first embodiment. The regulator 1 shown in FIG. 1 includes a first transistor Tr1, a feedback circuit 10, a second transistor Tr2, and a clamp circuit 4.

The first transistor Tr1 is connected between an input terminal IN and an output terminal OUT. The feedback circuit 10 controls a control voltage Vg of a control electrode of the first transistor Tr1 so that a voltage Vout of the output terminal OUT approaches a target voltage according to a feedback voltage Vfb proportional to the output voltage Vout. One end of the second transistor Tr2 is connected to the input terminal IN, and the control voltage Vg is applied to a control electrode of the second transistor Tr2 in common with the control electrode of the first transistor Tr1. The clamp circuit 4 sets the other end of the second transistor Tr2 to a voltage Vc determined by the voltage Vout of the output terminal OUT.

The first transistor Tr1 and the second transistor Tr2 are P-channel field effect transistors whose sources are connected to each other.

The feedback circuit 10 includes resistors R2 and R3 connected in series for generating the feedback voltage Vfb obtained by dividing the output voltage Vout, a comparison circuit 3 which receives the feedback voltage Vfb at its positive input node and a reference voltage Vref at its negative input node to output the control voltage Vg, N-channel field effect transistors M4 and M5 constituting a mirror circuit for increasing an operating current of the comparison circuit 3 when a current flowing through the second transistor Tr2 increases, and a resistor R1 for limiting a current flowing through the transistor M4.

The clamp circuit 4 sets a drain voltage of the second transistor Tr2 to be equal to a drain voltage (=the output voltage Vout) of the first transistor Tr1.

Figure 2:
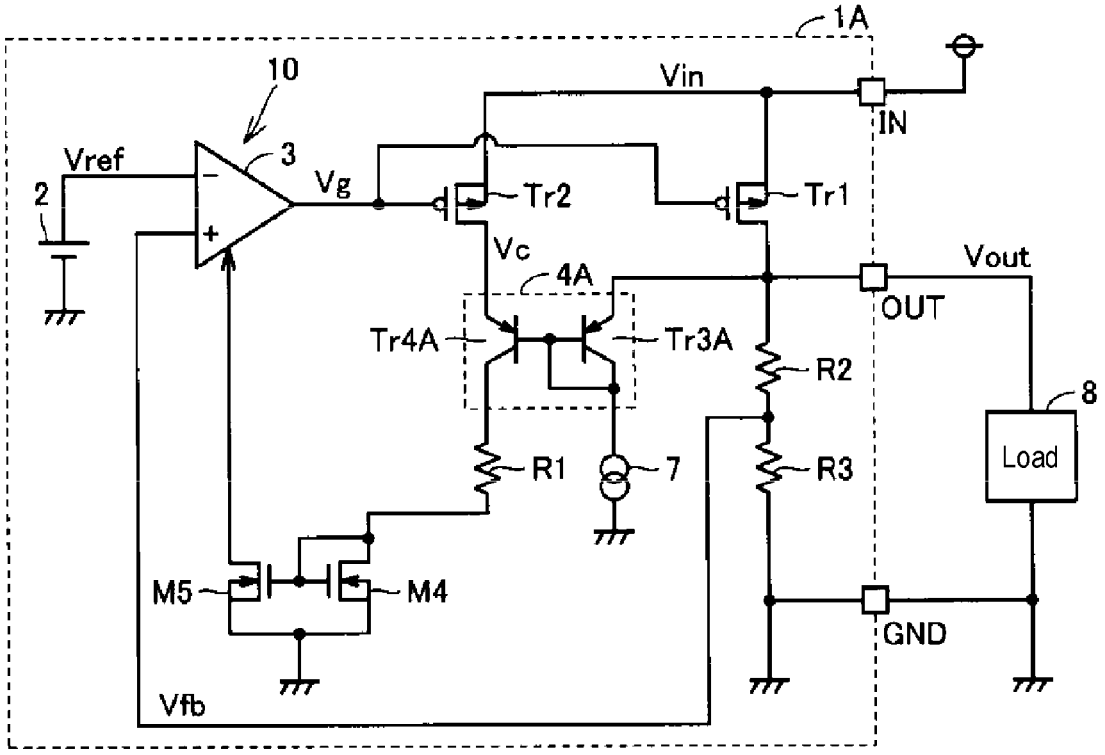
FIG. 2 is a circuit diagram showing a specific configuration example of a clamp circuit of the regulator of FIG. 1.

FIG. 2 is a circuit diagram showing a specific configuration example of the clamp circuit of the regulator of FIG. 1. The regulator 1A shown in FIG. 2 includes a clamp circuit 4A.

The clamp circuit 4A includes a third transistor Tr3A and a fourth transistor Tr4A. The third transistor Tr3A is a PNP transistor having an emitter connected to the output terminal OUT, and a base and a collector that are connected to a current source 7. The fourth transistor Tr4A is a PNP transistor having an emitter connected to the drain of the second transistor Tr2, and a base connected to the base and the collector of the third transistor Tr3A.

In the example of FIG. 2, a size of the third transistor Tr3A is equal to that of the fourth transistor Tr4A. Here, a size of a transistor indicates an ability to flow a current. A larger transistor size can provide a higher current flow through the transistor. As a result, a base potential of the third transistor Tr3A becomes a potential lowered by a base-emitter voltage Vbe (about 0.6 to 0.7V) than the potential Vout of the output terminal OUT. The base potential of the fourth transistor Tr4A is equal to the base potential of the third transistor Tr3A, and the emitter potential of the fourth transistor Tr4A is higher by Vbe than the base potential of the third transistor Tr3A. Therefore, the drain potential of the second transistor Tr2 is clamped to a voltage substantially equal to the output voltage Vout.

Therefore, when an input voltage Vin is lower than a target output voltage, even if the comparison circuit 3 lowers the control voltage Vg to make the first transistor Tr1 and the second transistor Tr2 conductive, since the drain voltage of the second transistor Tr2 does not decrease, a current flowing through the regulator from the second transistor Tr2 to the ground node is reduced.

Figure 3:
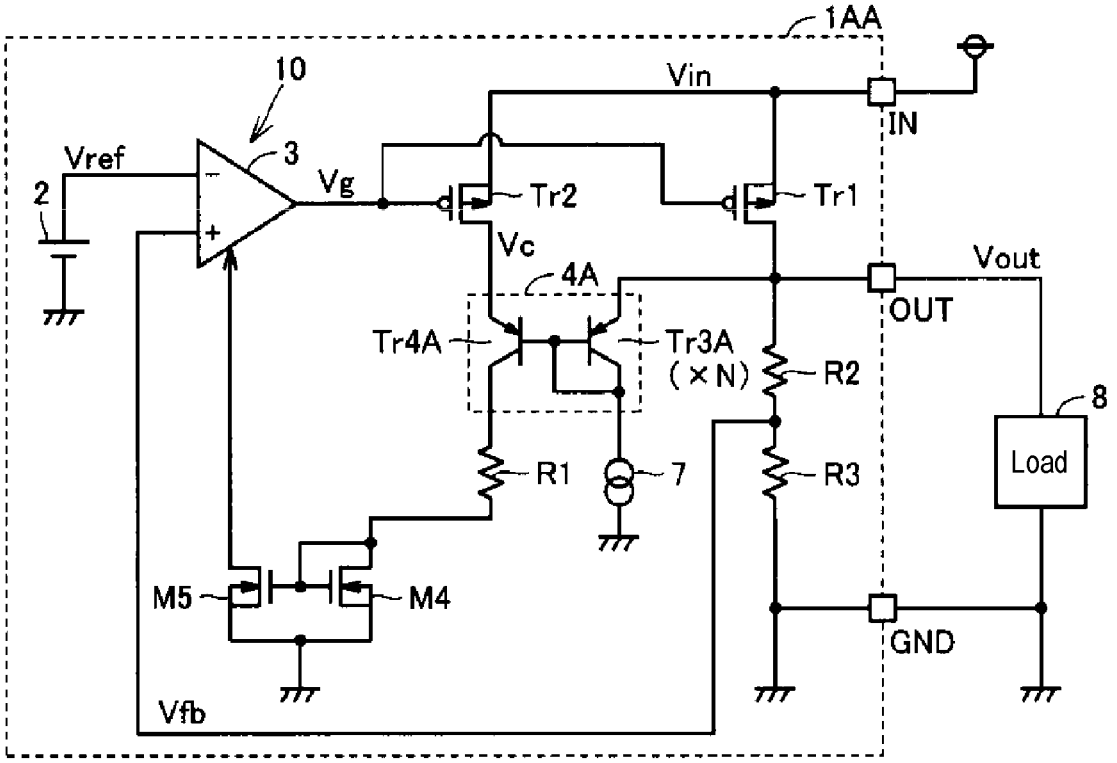
FIG. 3 is a circuit diagram showing the configuration of a modification of the regulator according to the first embodiment.

FIG. 3 is a circuit diagram showing a configuration of a modification of the regulator according to the first embodiment. The regulator 1AA shown in FIG. 3 is different from the regulator 1A of FIG. 2 in terms of the ratio of the transistors in the clamp circuit 4A.

The clamp circuit 4A generates an offset voltage in such a way that a drain-source voltage of the second transistor Tr2 decreases, as compared with the clamp circuit 4 shown in FIG. 2. That is, a clamp voltage Vc of the configuration of FIG. 3 is higher than a clamp voltage Vc of the configuration of FIG. 2.

Specifically, in the regulator 1AA shown in FIG. 3, a transistor size of the third transistor Tr3A is set to N times a transistor size of the fourth transistor Tr4A. At this time, the offset voltage generated between the emitter and the base of the fourth transistor Tr4A is represented by $V_T \ln N$. Here, the voltage $V_T$ is called a thermal voltage, which is about 26 mV at the room temperature, and ln is a natural logarithm. Therefore, the drain potential of the second transistor Tr2, that is, the clamp voltage Vc, is higher than the output voltage Vout. Therefore, even when various parameters vary, the current flowing through the regulator from the second transistor Tr2 to the ground node is stably reduced as compared with the circuit shown in FIG. 2.

In the example shown in FIG. 3, N may be larger than 1. That is, in the modification shown in FIG. 3, the size of the third transistor Tr3A is larger than the size of the fourth transistor Tr4A.

Figure 4:
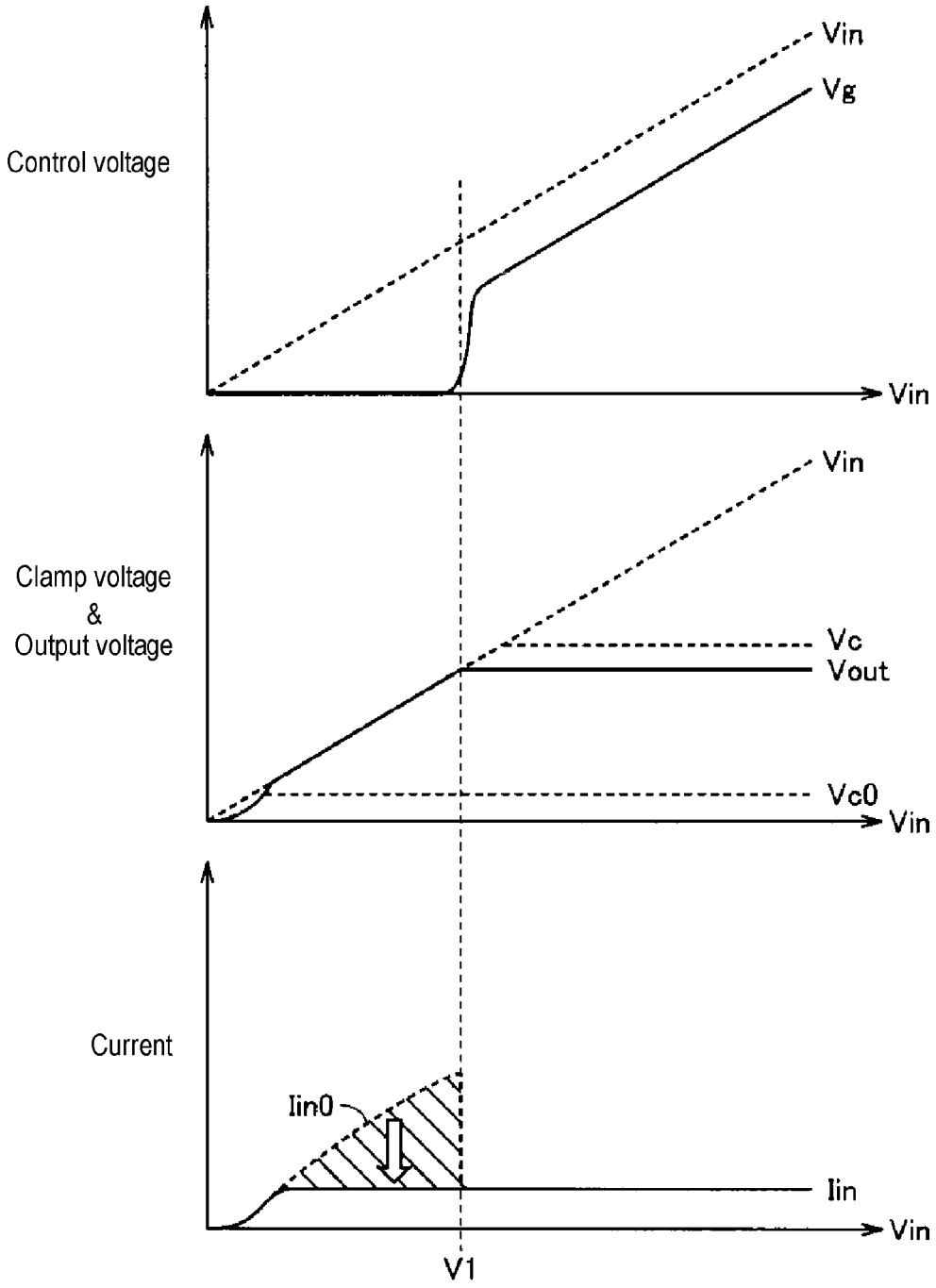
FIG. 4 is a graph showing a relationship between an input voltage and a current flowing through a regulator.

FIG. 4 is a graph showing a relationship between an input voltage and a current flowing through the regulator. In FIG. 4, the upper part shows how the control voltage Vg varies depending on the input voltage Vin. Further, the middle part shows how the output voltage Vout and the clamp voltage Vc vary depending on the input voltage Vin. Further, the lower part shows how a current Iin flowing through the regulator varies depending on the input voltage Vin.

Until the input voltage Vin reaches a predetermined value V1 from 0, the feedback circuit 10 generates the control voltage Vg in order to turn on the first transistor Tr1 irrespective of the load current. That is, since the comparison circuit 3 outputs a low level, the control voltage Vg becomes substantially 0. At this time, since the first transistor Tr1 is turned on, the output voltage Vout becomes equal to the input voltage Vin.

Normally, since the same voltage is generated between the gate and the source of the second transistor Tr2, the second transistor Tr2 is turned on, and a current tries to flow until it is limited by the driving capability of the second transistor Tr2 or the impedance of the load connected to the drain of the second transistor Tr2.

However, by adopting the circuit configuration shown in FIGS. 2 and 3, under the condition that the input voltage Vin ranges from 0 to a predetermined value V1, Vin=Vout and the drain voltage of the second transistor Tr2 also has the same potential as the input voltage Vin (=the source potential of Tr2).

When the input voltage Vin is equal to or higher than the predetermined value V1, in order to operate the feedback circuit 10 normally, the output voltage Vout is controlled to a set voltage (constant value) by the function of the regulator. Then, the drain voltage of the transistor Tr2 is set to the same voltage as the output voltage Vout by the clamp circuit 4 of FIG. 2, or is set to a voltage (the voltage Vc shown in FIG. 4) higher than the output voltage Vout by the clamp circuit 4A of FIG. 3 that generates the offset.

By adopting the clamp circuit 4, since the drain-source voltage of the second transistor Tr2 is zero until the input voltage Vin reaches the predetermined value V1 from 0, no drain current flows through the second transistor Tr2.

Without the clamp circuit, the drain voltage of the second transistor Tr2 is equal to a voltage Vc0. In this case, when the input voltage Vin becomes equal to or lower than the predetermined value V1, a current Iin0 may flow in a state where the second transistor Tr2 is turned on. Therefore, by adopting the clamp circuit, the effect that the current Iin flowing through the regulator is reduced as indicated by an arrow in FIG. 4 when the input voltage Vin is equal to or less than the predetermined value V1 can be obtained.

As described above, according to the regulator of the first embodiment, for example, when the input voltage Vin is lower than an output set voltage, such as when Vin rises or falls at the time of power ON/OFF or when a voltage of a battery as a power supply is lowered, the power consumption is reduced as compared with the conventional case.

Second Embodiment

Figure 5:
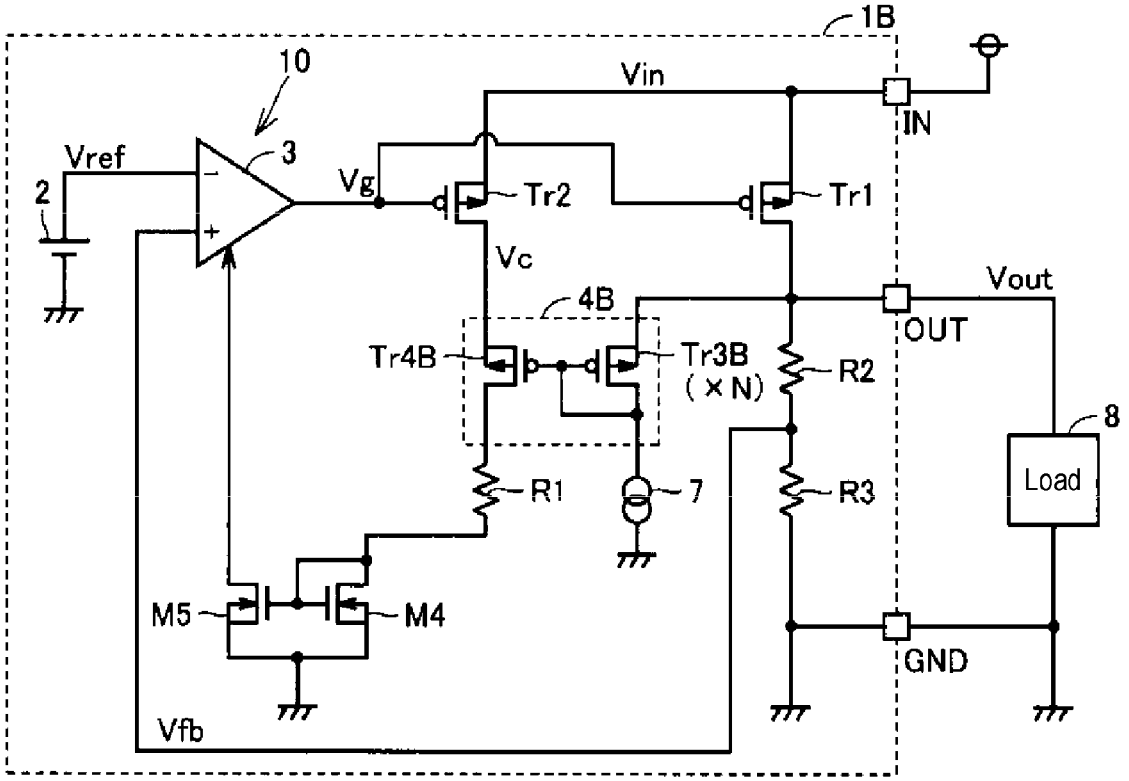
FIG. 5 is a circuit diagram showing a configuration of a regulator according to a second embodiment.

FIG. 5 is a circuit diagram showing the configuration of a regulator according to a second embodiment. The regulator 1B shown in FIG. 5 includes a first transistor Tr1, a feedback circuit 10, a second transistor Tr2, and a clamp circuit 4B.

The clamp circuit 4B includes a third transistor Tr3B and a fourth transistor Tr4B.

The third transistor Tr3B is a P-channel field effect transistor having a source connected to an output terminal OUT, and a gate and a drain that are connected to a current source 7. The fourth transistor Tr4B is a P-channel field effect transistor having a source connected to the drain of a second transistor, and a gate connected to the gate and drain of the third transistor.

The regulator 1B has the same configuration as the regulator 1A shown in FIG. 3 except for the clamp circuit 4B, and description thereof will not be repeated.

In this manner, even when a transistor of the clamp circuit is changed from a PNP transistor to a P-channel field effect transistor, the same effects as in the first embodiment can be obtained.

The size of the third transistor Tr3B may be equal to the size of the fourth transistor Tr4B with a size ratio N=1 between the third transistor Tr3B and the fourth transistor Tr4B or the size of the third transistor Tr3B may be larger than the size of the fourth transistor Tr4B with the size ratio N>1.

Third Embodiment

Figure 6:
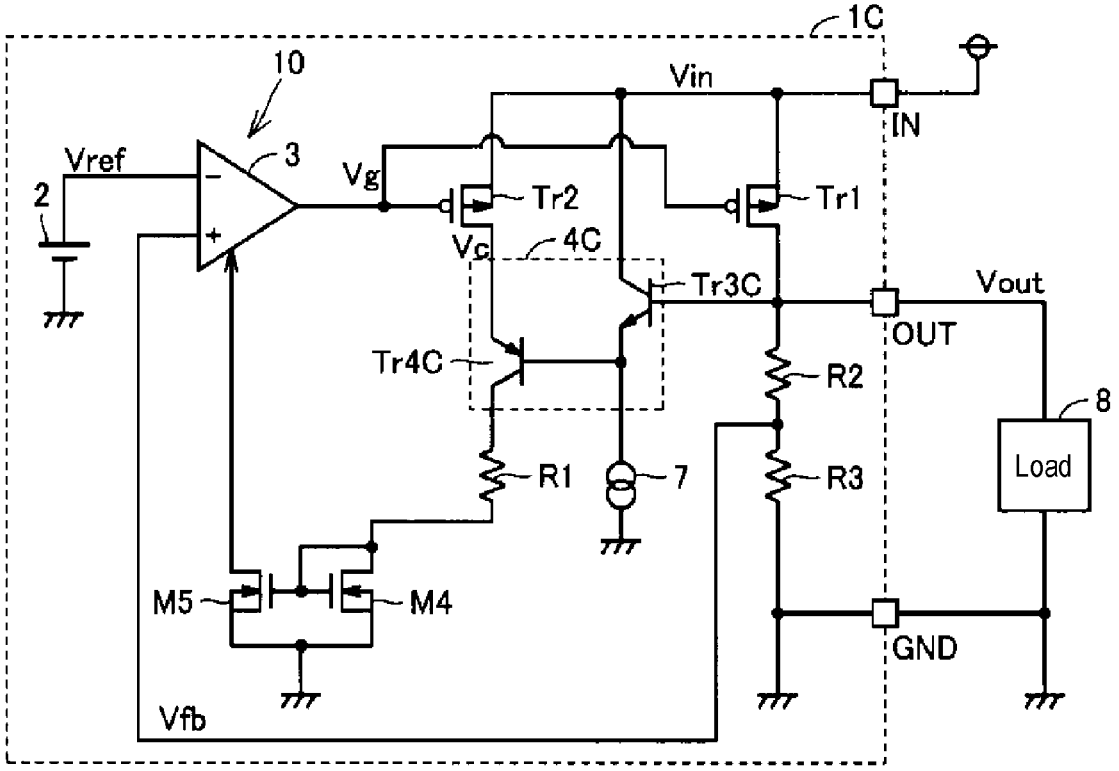
FIG. 6 is a circuit diagram showing a configuration of a regulator according to a third embodiment.

FIG. 6 is a circuit diagram showing a configuration of a regulator according to a third embodiment. The regulator 1C shown in FIG. 6 includes a first transistor Tr1, a feedback circuit 10, a second transistor Tr2, and a clamp circuit 4C.

The clamp circuit 4C includes a third transistor Tr3C and a fourth transistor Tr4C.

The third transistor Tr3C is an NPN transistor having a collector connected to an input terminal IN, a base connected to an output terminal OUT, and an emitter connected to a current source 7. The fourth transistor Tr4C is a PNP transistor having an emitter connected to the drain of the second transistor Tr2, and a base connected to the emitter of the third transistor Tr3C.

The regulator 1C has the same configuration as the regulator 1A shown in FIG. 3 except for the clamp circuit 4C, and description thereof will not be repeated.

Even with the configuration of the clamp circuit 4C, the drain potential of the second transistor Tr2 is determined by the output voltage Vout, the base-emitter voltage of the third transistor Tr3C, and the base-emitter of the fourth transistor Tr4C, and the same effects as in the first embodiment can be obtained.

Fourth Embodiment

Figure 7:
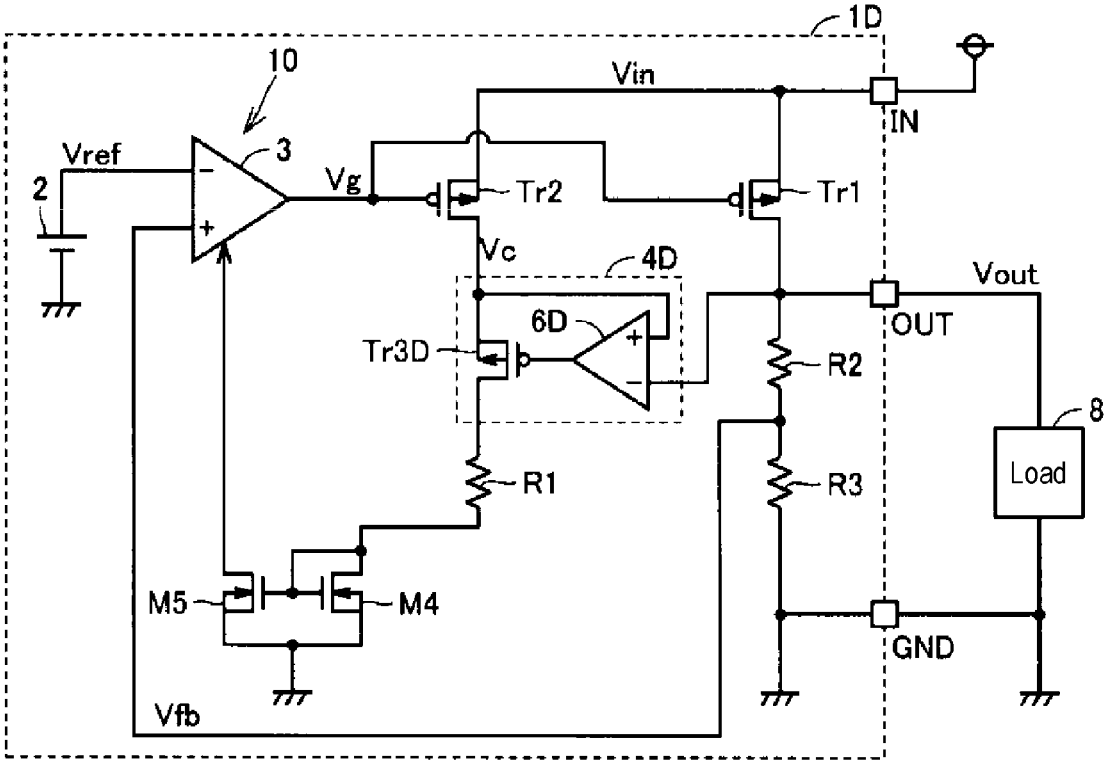
FIG. 7 is a circuit diagram showing a configuration of a regulator according to a fourth embodiment.

FIG. 7 is a circuit diagram showing the configuration of a regulator according to a fourth embodiment. The regulator 1D shown in FIG. 7 includes a first transistor Tr1, a feedback circuit 10, a second transistor Tr2, and a clamp circuit 4D.

The clamp circuit 4D includes a comparison circuit 6D and a third transistor Tr3D. The comparison circuit 6D has a negative input node connected to the output terminal OUT, and a positive input node connected to the drain of the second transistor Tr2. The third transistor Tr3D is a P-channel field effect transistor having a source connected to the drain of the second transistor Tr2, and a gate which receives the output of the comparison circuit 6D.

The regulator 1D has the same configuration as the regulator 1A shown in FIG. 3 except for the clamp circuit 4D, and description thereof will not be repeated.

With such a configuration, the comparison circuit 6D deactivates the third transistor Tr3D while Vc<Vout. Then, the voltage Vc is set to be equal to the voltage Vin by the second transistor Tr2 which is turned on. On the other hand, while Vc>Vout, the comparison circuit 6D activates the third transistor Tr3D. Then, the voltage Vc is pulled down and is eventually kept equal to the voltage Vout.

Therefore, even with the configuration as shown in FIG. 7, the same effects as in the first embodiment can be obtained.

According to the present disclosure in some embodiments, it is possible to provide a regulator capable of reducing power consumption especially when an input voltage is low.

While certain embodiments have been described, these embodiments have been presented by way of example only, and are not intended to limit the scope of the disclosures. Indeed, the embodiments described herein may be embodied in a variety of other forms. Furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A regulator comprising:

a first transistor connected between an input terminal and an output terminal;

a feedback circuit configured to control a control voltage of a control electrode of the first transistor such that a voltage of the output terminal approaches a target voltage according to a feedback voltage proportional to the voltage of the output terminal;

a second transistor having one end connected to the input terminal and a control electrode to which the control voltage is applied in common with the first transistor; and a clamp circuit configured to set the other end of the second transistor to a voltage determined by the voltage of the output terminal, wherein the second transistor is connected to a ground node only through a path including the clamp circuit, wherein the first transistor and the second transistor are P-channel field effect transistors whose sources are connected to each other, and wherein the clamp circuit includes:

a third transistor which is an NPN transistor having a collector to which the input terminal is connected, a base to which the output terminal is connected, and an emitter to which a current source is connected; and a fourth transistor which is a PNP transistor having an emitter to which a drain of the second transistor is connected, and a base to which the emitter of the third transistor is connected.

2. The regulator of claim 1, wherein a size of the third transistor is equal to a size of the fourth transistor.

3. The regulator of claim 1, wherein a size of the third transistor is larger than a size of the fourth transistor.

4. A regulator comprising:

a first transistor connected between an input terminal and an output terminal;

a feedback circuit configured to control a control voltage of a control electrode of the first transistor such that a voltage of the output terminal approaches a target voltage according to a feedback voltage proportional to the voltage of the output terminal;

a second transistor having one end connected to the input terminal and a control electrode to which the control voltage is applied in common with the first transistor; and a clamp circuit configured to set the other end of the second transistor to a voltage determined by the voltage of the output terminal, wherein the first transistor and the second transistor are P-channel field effect transistors whose sources are connected to each other, and wherein the clamp circuit includes:

a third transistor which is an NPN transistor having a collector to which the input terminal is connected, a base to which the output terminal is connected, and an emitter to which a current source is connected; and a fourth transistor which is a PNP transistor having an emitter to which a drain of the second transistor is connected, and a base to which the emitter of the third transistor is connected.

* * * * *